US005845783A

United States Patent [19]

Smith

[11] Patent Number: 5,845,783

[45] Date of Patent: Dec. 8, 1998

[54] METHOD AND APPARATUS FOR TREATING FLY ASH

[75] Inventor: Gregory Allan Smith, Perth, Australia

[73] Assignee: Pozzolanic Engerprises Pty Ltd, Queensland, Australia

[21] Appl. No.: 750,173

[22] PCT Filed: May 31, 1995

[86] PCT No.: PCT/AU95/00321

§ 371 Date: Dec. 2, 1996

§ 102(e) Date: Dec. 2, 1996

[87] PCT Pub. No.: WO95/33571

PCT Pub. Date: Dec. 14, 1995

[30] Foreign Application Priority Data

Jun. 2, 1994 [AU] Australia ..... PM 6064

[51] Int. Cl.[6] ..... B03C 7/10

[52] U.S. Cl. ..... 209/127.4; 209/127.2

[58] Field of Search ..... 290/127.3, 127.1, 290/127.2, 127.4, 129, 12.2

[56] References Cited

U.S. PATENT DOCUMENTS

| | | | |
|---|---|---|---|
| 827,115 | 7/1906 | Pickard | 209/127.2 |
| 2,225,096 | 12/1940 | Bullock | 209/129 |
| 2,361,946 | 11/1944 | Johnson et al. | 209/127.3 |
| 3,426,895 | 2/1969 | Bullock | 209/129 |
| 3,998,727 | 12/1976 | Giffard | 209/127 |
| 4,557,827 | 12/1985 | Fricke et al. | 209/127.4 |
| 5,484,061 | 1/1996 | Dunn | 209/127.4 |

FOREIGN PATENT DOCUMENTS

| | | |
|---|---|---|
| 100474 | 3/1937 | Australia . |
| 82253/87 | 6/1988 | Australia . |
| 0649681 | 4/1995 | European Pat. Off. . |
| 83-821770/47 | 11/1982 | Germany . |

*Primary Examiner*—William E. Terrell
*Assistant Examiner*—Patrick Mackey
*Attorney, Agent, or Firm*—Nixon & Vanderhye P.C.

[57] ABSTRACT

A method and apparatus for separation of carbonaceous particles from fly ash utilizes an electrostatic separator having a number of separation zones arranged to define a downward serpentine pathway for particulate material. The separation zones include spaced parallel planar electrodes with collectors positioned at the outlet of each separation zone to direct the respective carbonaceous and non-carbonaceous particles to respective storage hoppers. The feedstock is introduced to the apparatus via a rotary valve at a temperature of about 100° C. and the potential difference between respective pairs of electrodes is about 30 KV.

22 Claims, 5 Drawing Sheets

METHOD AND APPARATUS FOR TREATING FLY ASH

FIELD OF THE INVENTION

THIS INVENTION is concerned with an apparatus and method for the electrostatic separation of mixtures of particulate materials possessing differing electrical properties and in particular to separation of mixtures of substantially electrically conductive and substantially nonconductive materials.

BACKGROUND OF THE INVENTION

The apparatus and method of the invention are particularly although not exclusively directed to the separation of carbonaceous materials from fly ash obtained from combustion or incineration processes typically employed in coal fired power generators, brick kilns and ore roasting/calcining kilns as well as municipal waste incinerators.

Fly ash is obtained in large quantities from coal burning electric power generators and generally this recovered fly ash is used as a replacement or supplement for cement powder in the manufacture of concrete.

Depending upon the quality of the coal employed as a fuel and the efficiency of the combustion process, the recovered fly ash may contain varying amounts of partially combusted carbon particles up to about 10–12% by weight.

Internationally accepted standards for pozzolans, in particular, fly ash in the manufacture of concrete generally limit the amount of uncombusted carbon in the fly ash to below 4% and in consequence, fly ash from many potential sources cannot be employed in concrete manufacture.

With increasing environmental concerns and regulations relating to $NO_x$ and $S_x$o emissions from coal fired furnaces, furnace practice or operating conditions have been changed to reduce these emissions with the result that the carbon content of fly ash has increased thereby precluding previously acceptable sources.

There are many economic benefits to be obtained from the continued use of fly ash in cement powder production and accordingly there exists a need to remove excessive quantities of carbon from fly ash with an economically viable process.

Electrostatic separation of particulate materials having differing electrical properties is well known and generally falls into four categories—Electrophoresis, Conductive Induction, Contact Charging and Dielectrophoresis.

In electrophoretic separation, mixtures of conductive and non conductive particles are ionised in a corona discharge field such that all particles acquire a like surface charge. The charged particles are initially attracted to the surface of a grounded rotating metal roller or a stationary inclined metal plate, also grounded, having a convexly curved surface.

The grounded roller or plate allows the charge on conductive particles to dissipate quickly and as the particles either rotate with the metal roller or slide over the convex surface of the stationary plate, a combination of gravitational and centrifugal forces are applied to the particles. The conductive particles, being substantially discharged leave the surface of the roller or plate first under the influence of the forces applied whilst the charged non conductive particles cling to the surface for a longer period until gravitational forces exceed the attractive forces between the charged particles and the grounded surface over which they move. A splitter directs conductive and non conductive particles travelling through different trajectories to respective collection regions.

Conductive induction involves transportation of a mixture of conductive and non conductive particles on a grounded metal roller or curved, inclined metal plate through an electrostatic field generated by a spaced electrode having an opposite charge to the roller or plate.

Conductive particles on the transport surface acquire a charge of like sign to the transport surface both by conduction from the transport surface and induction by the spaced electrode of opposite charge. When the conductive particles become charged they are attracted towards the electrode and in a manner similar to that described above, the charged and uncharged particles follow differing trajectories as they leave the surface of the transportation means to facilitate splitting in a conventional manner.

Contact charging is one of the oldest forms of particle separation and relies upon the natural or triboelectric charge induced by direct contact with a charged surface or by friction. The charged particles are allowed to fall freely into an electrostatic field between electrodes of opposite potential which attract particles of respectively opposite charge to form spaced trajectories divided by a splitter.

Dielectrophoresis is similar to electrophoresis except that separation of particles is dependent on the polarisability of a material in a non uniform electric field.

There are many factors which affect the choice of electrostatic separator for mixtures of particulate materials and these are largely dependent on differing electrical, and physical properties between the materials to be separated.

For example, electrophoresis is commonly used to separate beach sands and alluvial tin ores, silica from iron and chromite ores and the separation of metallic and non metallic constituents. Conductive induction separation is often used in final rutile and zircon cleaning and removal of foreign contaminants from foodstuffs.

Dielectrophoresis is employed to separate fibres from tea, paper from plastics and fibrous from non fibrous materials.

Contact charging is rarely used in commercial applications as a single process but is used in other hybrid or combination electrostatic processes.

One such hybrid process described in U.S. Pat. No. 3,625,360 employs a corona discharge to charge a mixture of particles before allowing the particles to fall freely through an electrostatic field between spaced electrodes. The particles fall freely through a corona discharge ionising chamber and impinge on a series of grounded baffles before being allowed again to fall freely through an electrostatic field with a splitter therebelow.

German Patent Specification No. DE 3152018-C also describes a free fall electrostatic separation process wherein the particles are charged by "spray" electrodes before travelling through an electrostatic field in an airstream.

British Patent No. 1349995 describes a particle separator which imparts a curved trajectory to particles by exposure to magnetic and electrical fields arranged orthogonally to each other.

Russian Patent Specifications SU-822899 and SU-288907 describe electrostatic separators wherein the lower electrode is formed as a perforated screen. Document SU-822899 describes a plurality of perforated screens below the lower electrode screen for classifying particles which pass through the screens. Russian document SU-288907 describes the lower perforated electrode as a vibrating screen and an air blast is employed to remove fine particles adhering to the electrodes.

Another hybrid electrostatic separator is described in Russian Patent Specification No. SU1375346 wherein particles are triboelectrically charged on a vibratory feeder and then pass into electric fields created by divergent electrodes. The combined actions of the electrodes and a serrated ridge across the feed path assist in separating the particles.

U.S. Pat. No. 3,720,312 describes electrostatic separation of particulate minerals by an apparatus having a pair of spaced plates of a dielectric material between which the particulate material is fed. The particulate material is propelled longitudinally by a vibratory feeder attached to the lower plate. Arrays of divergent parallel electrodes are positioned on the outer surfaces of the dielectric plates and are energised with an AC voltage. Portion of the particulate material is repelled by the electrical fields and moves laterally relative to other particulate material travelling longitudinally of the plates.

The above prior art references represent a very small exemplification of a great plethora of prior art electrostatic separators. The existence of such a large number of prior art references illustrates not only an ongoing need to improve the efficiency of such separators but also that in most cases, electrostatic separators are generally designed for separation of a specific mixture of components or similar mixtures; having a particle size in the range of 75 microns to 1 mm in the case of inorganic sands and ores or up to 3 mm in the case of organic particles.

Apart from a small number of prior art documents described below which deal with the separation of carbon particles from fly ash, none of the prior art is concerned with the separation or classification of very fine particulate matter having a particle size in the range of 10–200 microns and a bulk density less than 1.0.

Indeed, there are no commercially available electrostatic separators which can separate carbon particles from fly ash on an economical basis.

In the electrostatic separation of carbonaceous materials from fly ash, the prior art suggests a relatively limited range of separators designed specifically for this purpose.

Russian Patent Specification No. SU994013 suggests pretreatment of power station fly ash at 1200°–1500° C. to form a mixture of small glass beads (70–80%) and coke coal grains (20–30%). This pretreated material is then subjected to the electric field of a conventional drum type corona discharge separator.

Australian Patent Application AU 21349/83 and AU 21350/83 describe an apparatus wherein one electrode is mounted on a conventional vibratory feeder and second electrodes are mounted above the first electrode each at an acute angle (typically 12°) in a lateral direction upwardly and outwardly. The electrodes are powered by a high voltage AC source and gives rise to curved field lines on each side of the electrode assemblies. The apparatus operates in a manner similar to that of U.S. Pat. No. 3,720,312 described above but in addition, utilises jets of air from a perforated lower electrode and an external jet to fluidise the particulate material thereby assisting in both separation and passage through the apparatus.

Australian Patent Specification No. AU 21350/83 describes a variation in the apparatus of AU 21349/83 in that the upper electrode assembly comprises regions of differing potential.

Both of Australian applications 21349/83 and 21350/83 suggest that initial charging of the carbon particles may be the result of ionisation, triboelectrification, conductive induction or a combination thereof.

U.S. Pat. Nos. 4,839,032 and 4,874,507 describe narrowly spaced electrode plates (10 mm or less) with a thin perforated sheet of dielectric material located in the centre of the space between the electrodes. A perforated continuous belt (PTFE coated Kevlar (Trade Mark)) is located on each side of the dielectric plate and in operation, the adjacent portions of belt separated by the plate move in opposite directions.

Particulate material is fed via an aperture in one electrode and friction between the particles gives rise to triboelectrification of the particles.

The applied electric field causes charged particles to migrate towards an electrode of opposite charge whereupon they are collected by the perforated belt and respectively move to opposite ends of the apparatus for collection.

While many of the prior art electrostatic separators are generally effective for their intended purpose, they all suffer from one or more shortcomings in terms of throughput rate, degree of separation, energy consumption, maintenance costs and high capital cost.

Where separation of high value minerals and the like is concerned, throughput rate, energy consumption and capital cost of the separation apparatus are not major considerations. In the case of low value materials such as fly ash however, these issues can contribute significantly to the financial viability of the separation process.

SUMMARY OF THE INVENTION

It is an aim of the present invention to provide an electrostatic separator which overcomes or alleviates at least some of the shortcomings of prior art separators and to provide a method and apparatus particularly suited to the separation of carbonaceous materials from fly ash.

According to one aspect of the invention there is provided an electrostatic separator for separation of a mixture of substantially electrically conductive particles and substantially electrically nonconductive particles, said apparatus comprising:

a plurality of separation zones, each separation zone comprising a pair of spaced parallel planar electrodes defining a downwardly inclined pathway having a lower transport surface and an upper collector surface spaced therefrom, said separation zones being spaced in an upright manner in alternating inclination with a lower end of a transport surface of a separation zone being positioned above an upper end of a transport surface of a next successive separation zone to define a serpentine pathway through which at least one component of said mixture is able to pass under the influence of gravity;

a power source coupled to said electrodes to provide, in use, a high voltage potential difference between each said pair of electrodes to generate an electric field therebetween, the respective electrodes comprising the transport surface of each pathway being electrically grounded;

feed means adapted to feed particulate material as a thin layer over the surface of an uppermost transport surface;

first collection means associated with the collector surface of each separation zone to collect particulate material attracted towards said collector surface under the influence of said electric field; and, second collection means associated with a lowermost transport surface to collect one component of a particulate mixture from which another component has been separated.

The planar electrodes are suitably comprised of metal plates.

Suitably the collector surface electrode is comprised of aluminium or aluminium alloy.

Preferably the transport surface electrode comprises an abrasion resistant material.

The transport surface electrode may comprise stainless steel or a wear resistant metal alloy.

If required the transport surface electrode may comprise a wear resistant surface such as an electrically conductive ceramic material or a cermet.

Suitably the peripheral edges of the electrodes are shaped to minimise arcing.

If required the electrodes may be adjustably mounted to selectively vary the angle of inclination.

The electrodes may have an angle of inclination in the range 45° to 85° relative to horizontal.

If required, some or all of the transport electrodes may include a heat source.

Also, if required, some or all of the transport electrodes may comprise a vibration means to assist transport of particulate material thereover in a thin layer.

The power source may comprise any suitable means for supply of an electrical potential in the range 15 to 50 KV.

The feed means may comprise a vibratory feeder.

Preferably the feed means comprises a metering means in association with said vibratory feeder to selectively feed particulate material to said vibratory feeder at a predetermined rate.

Suitably the metering means comprises a rotary valve located in the base of a feed hopper.

If required the feed hopper may include a heat source to maintain particulate material therein at a predetermined temperature.

The feed hopper may include means to prevent bridging of particulate material in the hopper.

The first and second collection means suitably comprise storage hoppers adapted for selective removal of respective components of said mixtures of particles.

According to a second aspect of the invention, there is provided a method of separating carbon particles from particulate fly ash, said method comprising the steps of:

feeding, under the influence of gravity, a thin layer of fly ash over the surface of a series of alternately inclined planar transport electrodes defining an upright serpentine pathway wherein a collector electrode is spaced from and parallel to each said transport electrode;

applying a high voltage electric potential between said transport and collector electrodes to create a substantially uniform electric field between said electrodes with said transport electrodes being electrically grounded whereby in use, carbon particles contained in the particulate fly ash acquire by conductive induction a charge of opposite sign to said collector electrodes and are attracted towards said collector electrodes away from the path of travel of substantially uncharged particles of fly ash over said transport electrodes, said carbon particles being collected in a first collection means associated with each said collector electrode and said fly ash particles being collected in a second collection means associated with a lowermost transport electrode in said serpentine pathway.

Suitably, fly ash is introduced into said serpentine pathway at a temperature in the range of from 50° to 130° C.

Preferably the fly ash is introduced at a temperature in the range of from 95° to 110° C.

The potential difference between the electrodes may be in the range of from 15 to 50 KV.

Suitably the potential difference between the electrodes is in the range 25–40 KV.

Preferably the potential difference between the electrodes is in the range 30–35 KV.

Most preferably the potential difference between the electrodes is a direct current potential.

If required the potential difference may be continuous or intermittent.

BRIEF DESCRIPTION OF THE DRAWINGS

In order that the invention may be more readily understood and put into practical effect, reference will now be made to preferred embodiments of the invention illustrated in the accompanying drawings in which.

DETAILED DESCRIPTION

Figure 1:
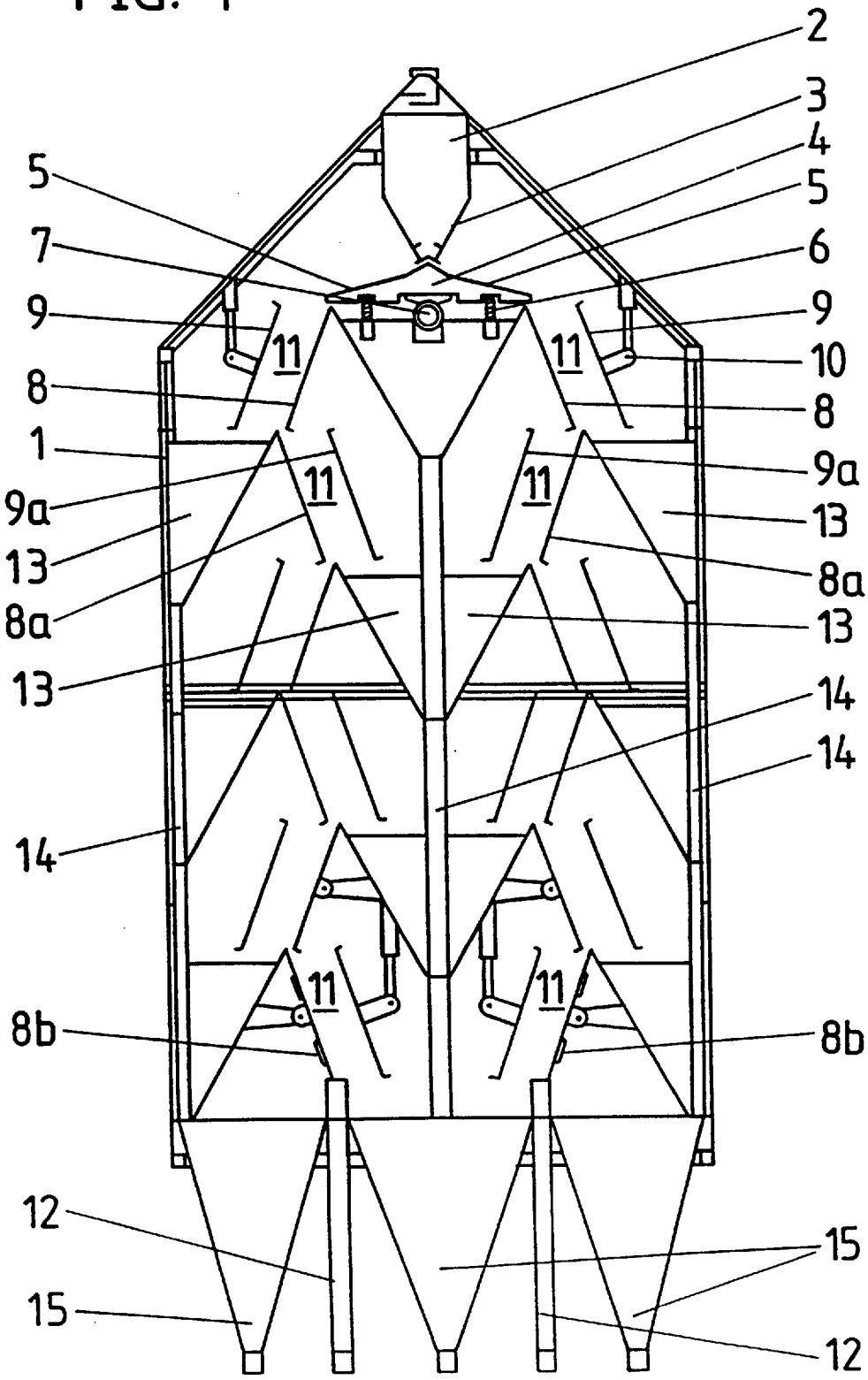
FIG. 1 illustrates schematically a cross sectional front elevation of an electrostatic fly ash separator.

In FIG. 1 the separation apparatus comprises a housing 1 having a fly ash feed hopper 2 located in the upper part thereof. The hopper may be fed by any suitable elevator means (not shown) such as a pneumatic lift, screw auger, belt or bucket conveyor.

The side walls 3 of hopper 2 may have electric heating elements (not shown) attached thereto to maintain the fly ash at a predetermined temperature.

Located below the feed hopper 2 is a vibratory feeder 4 having opposed inclined feed surfaces 5. The feeder 4 is resiliently mounted on springs 6 and a vibratory motion is imparted thereto by a rotating shaft 7 having eccentric masses (not shown). If required these eccentric masses may be in the form of cam surfaces which engage on a striker plate (not shown) mounted on the underside of feed surfaces 5.

Located immediately below the ends of feed surfaces 5 are downwardly inclined planar transport electrodes 8 and spaced therefrom are parallel collector electrodes 9 supported on insulated mounts 10. The spaced transport and collector electrodes 8, 9 each define a separation zone 11.

Immediately below the upper separation zones 11 are oppositely inclined separation zones 11, the lower end of transport electrode 8 being positioned above the upper end of a transport electrode 8*a* such as to collect any particulate matter falling from transport electrode 8 above. The vertically spaced array of alternately inclined transport electrodes 8, 8*a* defines a serpentine pathway for particulate material travelling under the influence of gravity across successive transport electrodes 8, 8*a* terminating in a lowermost transport electrode 8*b*. Lowermost electrodes 8*b* direct the flow of fly ash into outlet conduits 12.

Located below the lower end of each collector electrode 9, 9*a* is a collection chute 13 which directs carbon particles, collected from the fly ash stream, via conduits 14 to hoppers 15.

In use, carbon contaminated fly ash typically having a particle size in the range of 10–250 microns is introduced at a temperature of about 100°–110° C. onto the vibratory feeder 4. A flow splitter (not shown) divides the stream evenly onto oppositely inclined feed surfaces 5 which distributes the particulate matter in a fine layer across the upper surface of the upper transport electrodes 8.

A direct current potential difference of about 35 KV is maintained between respective pairs of electrodes 8, 9 with the transport electrodes 8, 8*a* all being electrically grounded with a positive potential.

As the thin layer moves across the surface of the transport electrodes 8, the particles are in direct contact with the positively charged plate. Under the operating conditions of the apparatus the fly ash particles are substantially non conductive relative to the carbon particles and as such pass through each separation zone largely unaffected.

The carbon particles however, by virtue of direct contact with the positively charged transport electrode and also due to the inductive effects of the applied electric field acquire a positive charge. When charged by this conduction induction process, the positively charged particles are then attracted towards the negatively charged collector electrodes 9.

Depending upon the degree of charge acquired by the carbon particles and the mass of the particles, some will be attracted on to the negatively charged collector electrode 9 whereupon they are discharged on contact and fall into a respective collection chute 13. Other carbon particles having, say, a lesser degree of charge and/or a greater mass will depart from the transport electrodes 8 and under the combined effects of gravity and the applied electrostatic force in the separation zones 11, will follow an arcuate trajectory into collection chutes 13.

During the separation process, the upper edges of the transport electrodes 8 act as splitters to divide the streams of carbon particles and fly ash.

Build up of carbon particles on the collector electrodes 9 is minimised by the steep angle of inclination as well as the effects of carbon particles impacting on the collector electrodes 9 with considerable velocity.

Figure 2:
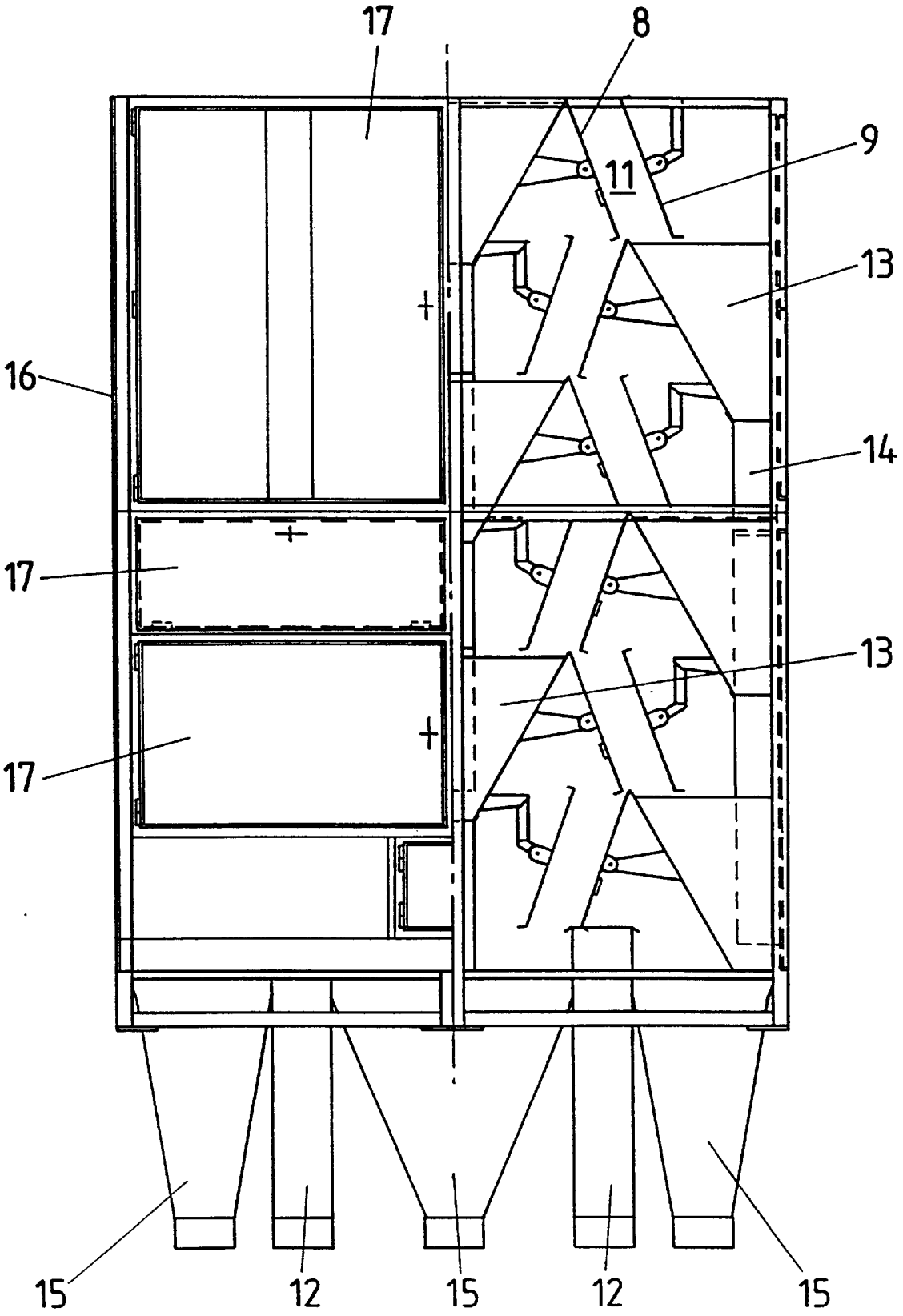
FIG. 2 illustrates a part cross sectional view of a separation chamber.

FIG. 2 shows a part sectional view of the separation chamber region of the apparatus of FIG. 1 and the collection means.

The end walls of the separation chamber 16 include access hatches 17 for maintenance and it will be noted that the electrodes 8, 9 are pivotally mounted to enable selective adjustment of the angles of inclination of the electrodes to compensate for variations in the properties of the fly ash obtained from differing sources.

Figure 3:
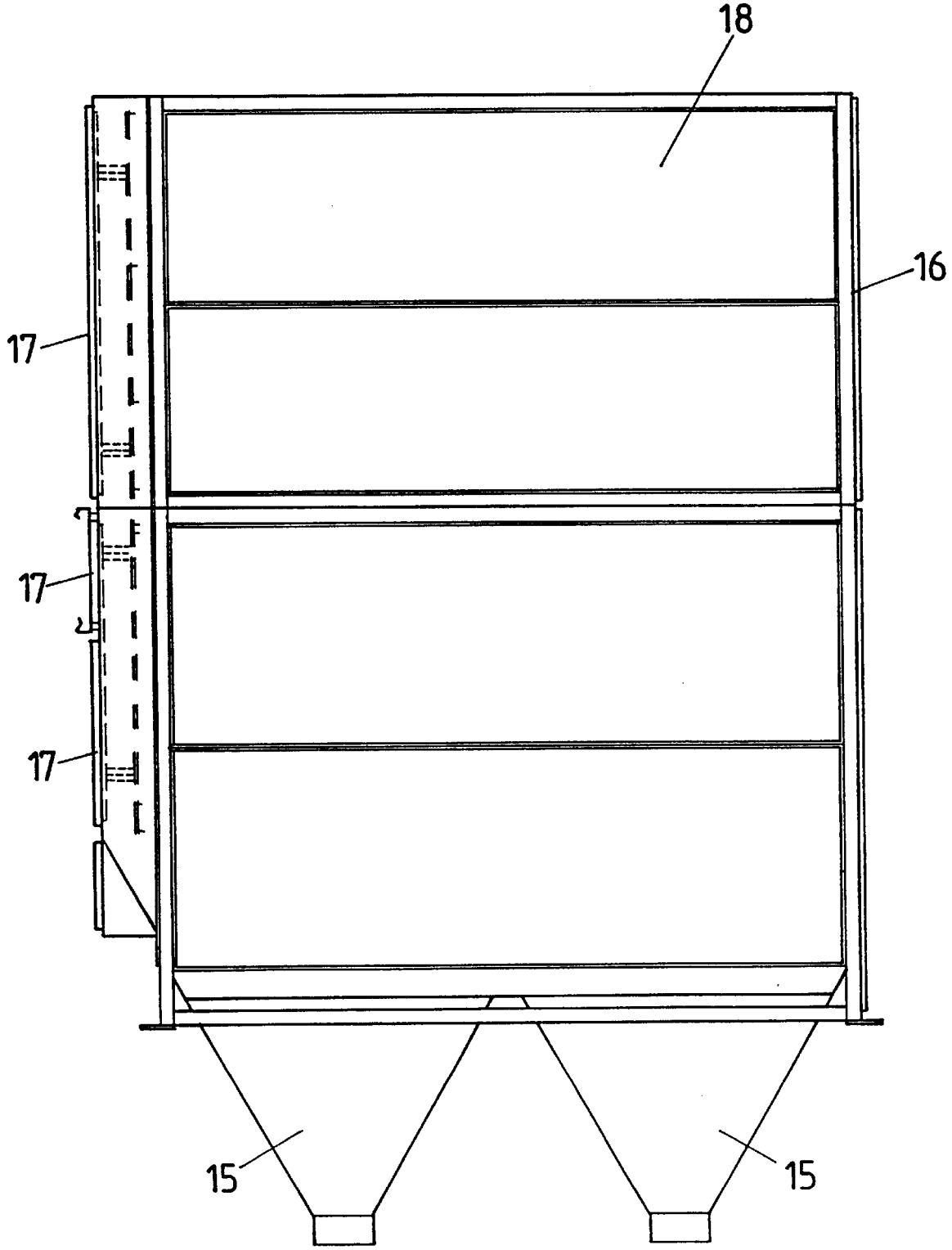
FIG. 3 illustrates a side elevation of the apparatus of FIG. 2.

FIG. 3 shows a side elevation of the apparatus of FIG. 2 with side panels 18 which may be removed for maintenance purposes.

Figure 4:
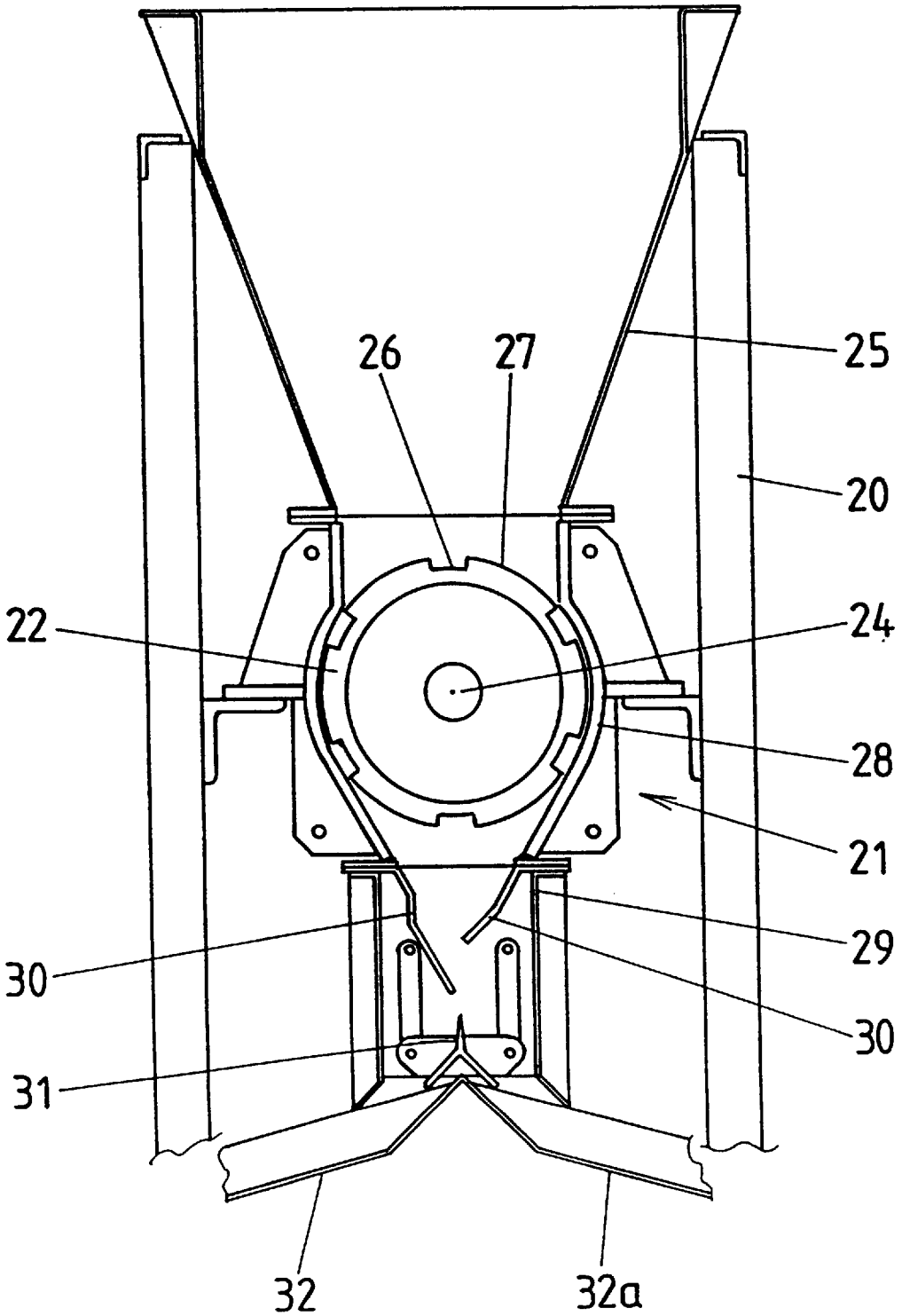
FIG. 4 illustrates a cross sectional front elevation view of a feed mechanism.
Figure 5:
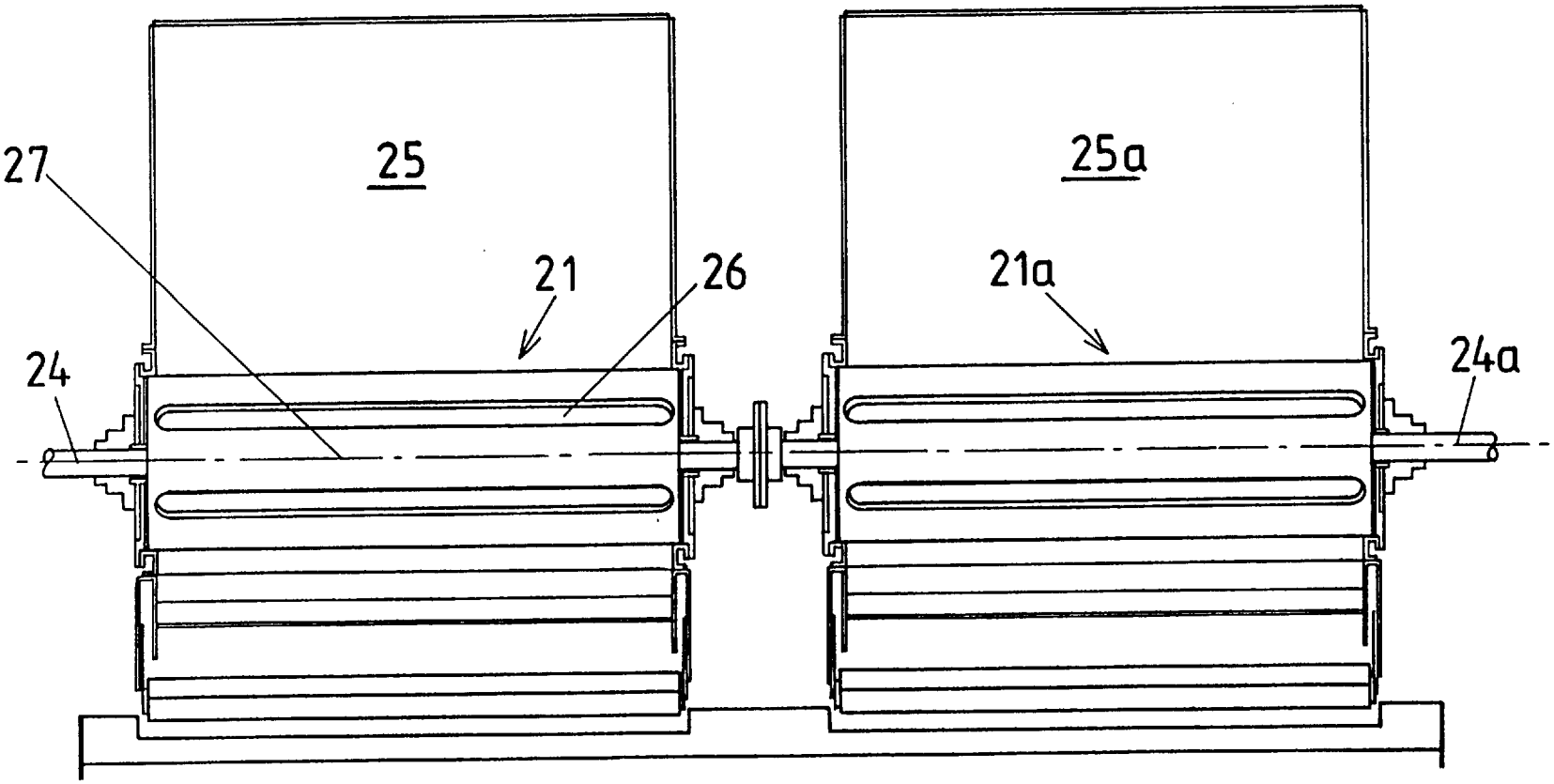
FIG. 5 illustrates a part sectioned side view of the apparatus of FIG. 4.

FIGS. 4 and 5 show an enlarged view of the feed mechanism of the apparatus shown in FIG. 1.

Supported on frame 20 is a rotary valve 21 having a rotor 22 journalled in bearings 23 for rotation about shaft 24. For convenience as shown in FIG. 5, the feed mechanism comprises a pair of rotary valves 21, 21*a* each with a respective feed hopper 25, 25*a*, the adjacent ends of shafts 24, 24*a* being coupled to permit operation by a single drive mechanism (not shown).

Rotor 22 comprises a plurality of elongate slots 26 spaced about a cylindrical wall surface 27 which is accommodated in a housing 28 having opposed walls with a part cylindrical concave recess complementary with the wall surface 27 of rotor 22 to form a seal between hopper 25 and feed throat 29.

As valve rotor 22 rotates at a predetermined rate, fly ash is metered into feed throat 29 where by means of guides 30 the feed is directed onto an adjustable splitter 31 which is adapted to permit the feed stream to be evenly divided on the feed surfaces 32, 32*a* of the vibratory feeder.

Typically, an apparatus of the type illustrated in FIGS. 1–3 may comprise electrodes spaced from 100 mm to 300 mm (preferably 190 mm), with electrodes measuring from 100 m to 800 mm (preferably 500 mm) in width (flow path length). The electrodes may be of any suitable length (feed width), suitably of the order of 2 meters.

An apparatus of these preferred dimensions is capable of processing from between 1.5 and 4 tons of fly ash per hour.

It will be readily apparent to a skilled addressee that many modifications and variations may be made to the various aspects of the invention without departing from the spirit and scope thereof.

For example, depending upon the quality of the fly ash feedstock and the degree of carbon separation required, the number of vertically spaced separation zones may be increased or decreased to suit.

The modular nature of the apparatus permits a plurality of separators to be interconnected end to end to permit filling of the feed hoppers by one or more elevator means and the rotary valves to be actuated by a single drive means.

Although the method and apparatus have been described with particular reference to the separation of carbon particles from fly ash, it is considered that with appropriate modification, the apparatus may be applicable to separation of other fine particulate mixtures of relatively conductive and non conductive materials.

I claim:

1. An electrostatic separator for separation of a particulate mixture having as components thereof substantially electrically conductive particles and substantially electrically non-conductive particles, said apparatus comprising:

a plurality of separation zones vertically spaced from each other to define upper and lower separation zones, each separation zone comprising a pair of spaced parallel planar electrodes defining a downwardly inclined pathway having a lower transport surface and an upper collector surface spaced therefrom, said separation zones being spaced in an upright manner in alternating inclination with a lower end of a transport surface of a separation zone being positioned above an upper end of a transport surface of a next successive separation zone to define a serpentine pathway through which at least one component of said mixture is able to pass under the influence of gravity;

a power source coupled to said electrodes to provide a high voltage potential difference between each said pair of electrodes to generate an electric field therebetween, the respective electrodes comprising the transport surface of each pathway being electrically grounded;

a feeder which feeds the particulate mixture as a thin layer over the transport surface of an upper separation zone;

a first collector associated with the collector surface of each separation zone to collect substantially electrically conductive particles attracted towards said collector surface from said corresponding transport surface under the influence of said electric field;

a second collector associated with a lower separation zone to collect substantially electrically non-conductive particles from which conductive particles have been removed; and said separation zones, power source, and collectors positioned and provided so that substantially nonconductive particles pass over said transport surfaces and are discharged from a respective lower end thereof, and are collected by said second collector.

2. A separator as claimed in claim 1 wherein said planar electrodes are metal plates.

3. A separator as claimed in claim 2 wherein said collector surface electrode is made of aluminium or aluminium alloy.

4. A separator as claimed in claim 2 wherein said transport surface electrode is made of an abrasion resistant material.

5. A separator as claimed in claim 4 wherein said transport surface electrode is made of stainless steel or a wear resistant metal alloy.

6. A separator as claimed in claim 1 wherein said transport surface electrode includes an electrically conductive ceramic material or a cermet forming a wear resistant surface thereof.

7. A separator as claimed in claim 1 wherein said electrodes have peripheral edges which are shaped to minimize arcing.

8. A separator as claimed in claim 1 wherein said electrodes are inclined in the range 45° to 85° to horizontal.

9. A separator as claimed in claim 1 wherein the power source comprises means for supplying an electrical potential in the range 15 to 50 KV.

10. A separator as claimed in claim 1 wherein said feeder comprises a vibratory feeder.

11. A separator as claimed in claim 10 wherein said feeder further comprises a metering device associated with said vibratory feeder to selectively feed particles to said vibratory feeder at a predetermined rate.

12. A separator as claimed in claim 11 wherein said metering device comprises a rotary valve located in the base of a feed hopper.

13. A separator as claimed in claim 1 wherein said first and second collectors each comprise a storage hopper which selectively removes respective components of the mixtures of particles.

14. A method of separating carbon particles from particulate fly ash using a series of alternating inclined planar transport electrodes defining an upright serpentine pathway, with a collector electrode spaced from and parallel to each transport electrode, a first collector for collecting carbon particles, and a second collector for collecting fly ash particles from which carbon particles have been separated, said method comprising the steps of:

(a) under the influence of gravity feeding a thin layer of fly ash containing carbon particles over the surfaces of the series of alternately inclined planar transport electrodes defining the upright serpentine pathway;

(b) as the fly ash moves downwardly in the serpentine pathway, applying a high voltage electric potential between the transport and collector electrodes to create a substantially uniform electric field between the electrodes, with the transport electrodes being electrically grounded, so that by conductive induction carbon particles contained in the particulate fly ash acquire a charge of opposite sign to the collector electrodes and are attracted towards the collector electrodes away from the path of travel of substantially uncharged particles of fly ash moving over the transport electrodes;

(c) collecting the carbon particles in a first collector associated with each collector electrode; and (d) separately collecting the fly ash particles from which carbon particles have been separated in a second collector associated with a lowermost transport electrode in the serpentine pathway.

15. A method as claimed in claim 14 wherein step (a) is practiced by introducing the fly ash into the serpentine pathway at a temperature in the range of from 50° to 130° C.

16. A method as claimed in claim 15 wherein step (a) is practiced by introducing the fly ash at a temperature in the range of from 95° to 110° C.

17. A method as claimed in claim 14 wherein step (b) is practiced to provide a potential difference between the electrodes in the range of from 15 to 50 KV.

18. A method as claimed in claim 17 wherein step (b) is practiced to provide a potential difference between the electrodes in the range of 25–40 KV.

19. A method as claimed in claim 18 wherein step (b) is practiced to provide a potential difference between the electrodes in the range of 30–35 KV.

20. A method as claimed in claim 14 wherein step (b) is practiced to provide the potential difference between the electrodes as a direct current potential.

21. A method as claimed in claim 14 wherein step (b) is practiced to provide the potential difference as continuous.

22. A method as claimed in claim 14 wherein step (b) is practiced to provide the potential difference as intermittent.

* * * * *